US008276226B2

(12) United States Patent
Kim

(10) Patent No.: US 8,276,226 B2
(45) Date of Patent: Oct. 2, 2012

(54) METHOD OF MANUFACTURING THE STUFFING OF PILLOW USING SEEDS OF DRUPES AND PILLOW FILLED WITH THE STUFFING MANUFACTURED THEREBY

(76) Inventor: Sung-Eon Kim, Seong-nam-si (KR)

( * ) Notice: Subject to any disclaimer, the term of this patent is extended or adjusted under 35 U.S.C. 154(b) by 340 days.

(21) Appl. No.: 12/449,714

(22) PCT Filed: May 13, 2008

(86) PCT No.: PCT/KR2008/002650

§ 371 (c)(1),
(2), (4) Date: Mar. 15, 2010

(87) PCT Pub. No.: WO2008/140237

PCT Pub. Date: Nov. 20, 2008

(65) Prior Publication Data

US 2012/0036640 A1 Feb. 16, 2012

(30) Foreign Application Priority Data

May 14, 2007 (KR) ..... 10-2007-0046445

(51) Int. Cl.
*A47C 20/00* (2006.01)

(52) U.S. Cl. ..... 5/636; 5/690; 5/951

(58) Field of Classification Search ..... 5/951, 690, 5/636
See application file for complete search history.

(56) References Cited

U.S. PATENT DOCUMENTS

| | | | | |
|---|---|---|---|---|
| 4,459,903 | A * | 7/1984 | Yamamoto | 99/519 |
| 5,689,844 | A * | 11/1997 | Liu | 5/636 |
| 2005/0091748 | A1* | 5/2005 | Ku | 5/636 |
| 2005/0114999 | A1* | 6/2005 | Cuozzo | 5/644 |
| 2005/0166330 | A1* | 8/2005 | Williams | 5/740 |
| 2007/0275866 | A1* | 11/2007 | Dykstra | 510/101 |

FOREIGN PATENT DOCUMENTS

| | | | |
|---|---|---|---|
| JP | 4325119 | | 11/1992 |
| JP | 2809527 | B2 * | 10/1998 |
| JP | 14085201 | | 3/2002 |
| KR | 200318367 | | 6/2003 |
| KR | 100588427 | | 6/2006 |

* cited by examiner

*Primary Examiner* — Robert G Santos
*Assistant Examiner* — David E Sosnowski
(74) *Attorney, Agent, or Firm* — Sherr & Jiang, PLLC

(57) ABSTRACT

A method of manufacturing the stuffing of a pillow, includes washing seeds of collected drupes to remove alien materials from the seeds, crushing the seeds removed of the alien materials into a predetermined size, polishing surfaces of the products of the seeds crushed into a predetermined size to be smooth and round and drying the resultant crushed products.

6 Claims, 1 Drawing Sheet

[Fig. 1]
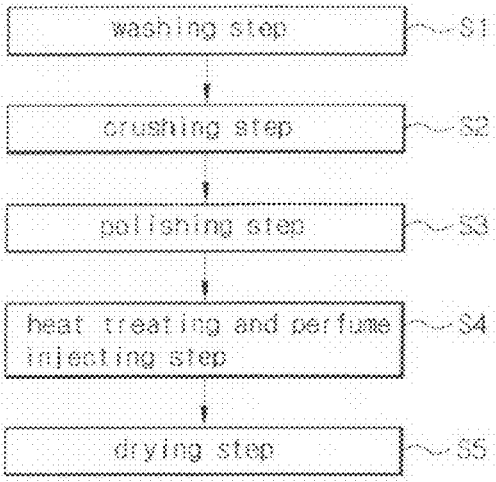
[Fig. 2]
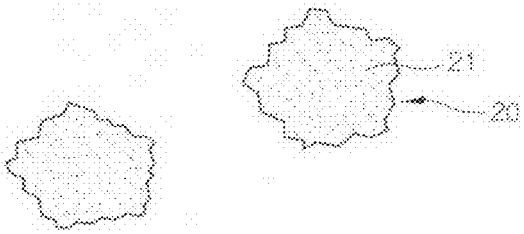
[Fig. 3]
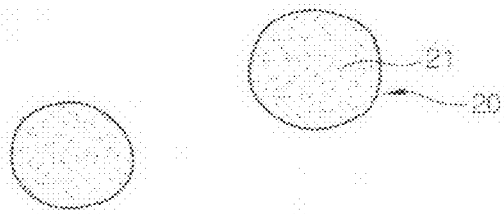
[Fig. 4]
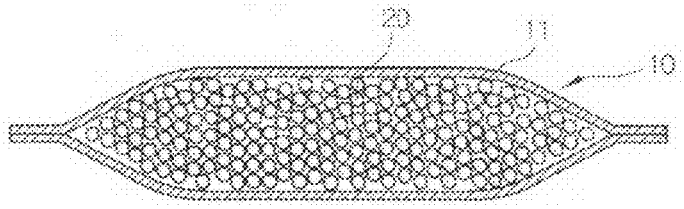
[Fig. 5]
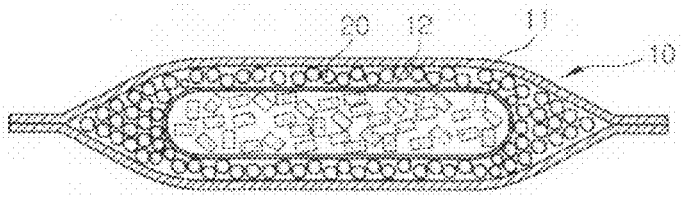

METHOD OF MANUFACTURING THE STUFFING OF PILLOW USING SEEDS OF DRUPES AND PILLOW FILLED WITH THE STUFFING MANUFACTURED THEREBY

REFERENCE TO RELATED APPLICATIONS

This application is based on and claims the benefit of PCT application No. PCT/KR/2008/002650 filed on May 13, 2008 which claims the benefit of Korean Patent No. 10-2007-0046445 filed on May 14, 2007, the entire contents of each of which are herein incorporated by reference.

TECHNICAL FIELD

The present invention relates to a method of manufacturing the stuffing of a pillow using seeds of drupes and a pillow filled with the stuffing manufactured thereby, and more particularly, to a method for manufacturing the stuffing of a pillow using seeds of drupes and a pillow filled with the stuffing manufactured thereby, which is not easily damaged in spite of long use and can provide a comfortable sleep for a user by improving feelings of contact with a head of a user, and can have comfortable feelings at the time of taking a rest.

BACKGROUND ART

In general, a widely used pillow is manufactured by filling a cushion material such as chemical a cotton material into a shell of the pillow.

However, because such a conventional pillow as described above has disadvantages that a material harmful to the human body is emitted from the chemical material filled in the pillow and ventilation is reduced, nowadays, a pillow manufactured by employing seeds of fruits as the stuffing of a pillow is used to improve health of a user.

For instance, in Korean registered Patent Gazette No. 10-0658826, there is disclosed a structure for a pillow using seeds of fruits, which are manufactured by coating yellow soil on a surface of a natural material including a seed of a fruit, such as a peach, an apricot, a maesil, a prune, and the like, which have been disposed till now without any recycling, additionally coating a natural material on an outer surface of the resultant soil layer of the seed, and drying it.

However, in the conventional art, since the stuffing of the pillow, is made by using seeds of fruits such as a peach, an apricot, a maesil, and a prune, which are called as a drupe, a disadvantage is caused that pain is generated from the pressure applied on a back portion of a head of a user by an outer appearance and a strength of the seed of the fruit when the user lay his head on the pillow, rather than the user felt comfortable.

The reason is because a seed of a fruit, which is used as the stuffing of a pillow, has a diameter about 1 cm to 3 cm, a wide surface area, sharp portions, and is hard in property, so that such property is applied on the head of the user as it applies the pressure to the back portion of the head to thereby generate the pain. In addition, while the conventional art could make use of fragrance of a seed of a drupe, the effect is tiny.

DISCLOSURE OF INVENTION

Technical Problem

Accordingly, the present invention has been made to solve such conventional problems, and it is an object of the present invention to provide a method of manufacturing the stuffing of a pillow using seeds of drupes and a pillow filled with the stuffing manufactured thereby, which is very easy in emission of fragrance as well as in permeation of the perfune, and provide good feelings at the time of contacting with a head of a user, so that a comfortable sleep of the user is maintained and a comfortable rest can be taken.

Technical Solution

To achieve the above object, the present invention provides a method of manufacturing the stuffing of a pillow, comprising the steps of washing seeds of collected drupes to remove alien materials from the seeds; crushing the seeds removed of the alien materials into a predetermined size; polishing surfaces of the products of the seeds crushed into a predetermined size to be smooth and round; and drying the resultant crushed products, after the polishing step.

Advantageous Effects

Therefore, according to the present invention, it is possible to take a comfortable sleep and have comfortable feelings at the time of taking a rest because emission of fragrance is very easy, and perfume can be easily permeated into the stuffing, and it becomes very good in contacting with a head of a user.

Also, according to the present invention, since the seeds of the drupes are crushed into a predetermined size and fragrance is emitted from the polished crushed products of the seeds, it becomes very helpful to take a deep sleep.

In addition, according to the present invention, since perfume is permeated into the stuffing separately, it is possible to take a comfortable sleep or take a comfortable lying and rest due to perfune emitted from the stuffing of a pillow.

Moreover, according to the present invention, it is possible to provide a vegetable pillow by recycling disposed drupes, so that a chemical pillow can be replaced by it.

Furthermore, according to the present invention, since fragrance is emitted from the stuffing of a pillow, although stinky such as sweat odor, underarm odor, feet odor, and the like is emitted, circunferential people including himself can feel less stinky.

BRIEF DESCRIPTION OF THE DRAWINGS

FIG. 1 is a view showing a method of manufacturing the stuffing of a pillow according to the present invention.

FIG. 2 is a view showing a crushed product of a seed after carrying out a crushing step of the manufacturing method of the present invention.

FIG. 3 is a view showing a state of the crushed product, in which a crushed product of the seed is made smooth and round by polishing sharp portions, after carrying out a polishing step of the manufacturing method of the present invention.

FIG. 4 is a cross-sectional view of a pillow using the stuffing of a pillow of the present invention.

FIG. 5 is a cross-sectional view of a pillow having a different structure using the stuffing of the present invention.

MODE FOR THE INVENTION

Hereinafter, the preferred embodiment of the present invention will be described in detail with reference to the appended drawings.

In the present invention, FIG. 1 is a view showing a method of manufacturing the stuffing of a pillow according to the present invention, FIG. 2 is a view showing crushed product of a seed after carrying out a crushing step of a manufacturing method of the present invention, FIG. 3 is a view showing a state of a crushed product, in which the crushed product of a seed is made smooth and round by polishing sharp portions, after the carrying out of the polishing step of the manufacturing method of the present invention, FIG. 4 is a cross-sectional view of a pillow using the stuffing of the present invention, and FIG. 5 is a cross-sectional view of a pillow having a different structure using the stuffing of the present invention.

A method of manufacturing the stuffing of a pillow according to the present invention will be described in detail with reference to FIG. 1.

At first, a step of washing seeds of collected drupes is carried out to remove alien materials from them by using a washing device (S1). By carrying out the washing step (S1), the alien materials attached at outer surfaces of the seeds of the drupes can be removed.

Then, a step (S2) of crushing the seeds of the drupes, in which the alien materials are removed through the washing step (S1), is carried out by using a pulverizing device or a crusher to result in crushed products of a predetermined size ranging from about 2.5 mm to 3.5 mm.

As shown in FIG. 2, crushed products 20 of the seeds can be obtained by carrying out the crushing step (S2). Herein, the reason why the seeds of the drupes are crushed is to expose minute pores 21 so that fragrance of the drupe itself can be easily emitted or permeation of perfune can be facilitated.

Thereafter, a step (S3) of polishing surfaces of the crushed products of the seeds, is carried out to polish the surfaces of the crushed products to be smooth and round.

As shown in FIG. 3, sharp portions and projections formed on the surfaces of the crushed products 20 of the seeds can be polished to be smooth and round by carrying out the polishing step S3.

Thus, the stuffing of a pillow obtained through the present invention comprised of the above steps, can solve a disadvantage of causing pains due to transmission of the hard feeling and sharp portions of the seeds of the fruit themselves, at the time of lying his head on the pillow, which is produced from the conventional art of using the seeds of the drupes themselves as the stuffing of a pillow.

Meanwhile, the polishing step is carried out by stirring products made by mixing the crushed products of the seeds crushed in a predetermined size with polishing members such as a pebble, and the like. Thereby, sharp portions formed on the surfaces of the crushed products of the seeds produced in the course of the crushing, can be polished to be smooth and round by the agitation with the polishing members and abrasion, resulting in the entire round shape and size of the crushed products of seeds proper to be used for the stuffing of a pillow.

Herein, how to separate the crushed products of the seeds from the pebbles, which are used as polishing members, is to make use of difference of specific gravity, for instance. That is, when water is filled in a container, in which the crushed products of the seeds and the pebbles, which are polishing members, are mixed, while the pebbles are submerged, the crushed products of the seeds become to float on the water, so that they can be separated from the polishing members by picking them out from the water.

Meanwhile, as shown in FIG. 3, in the course of the polishing step, a step (S4) of heat treating and perfune injecting is carried out with respect to the polished products. Hereinafter, the heat treating and perfume injecting step (S4) will be described in detail.

At first, necessary perfune is selected from several perfume such as aroma, peppermint, lemon, rose, and the like, and diluted in the distilled water. The reason of diluting perfume in the distilled water is because it is liquid obtained by vaporizing and purifying the water, and is removed of all bacteria and impurities contained in the water, and has no-color and no-smell, while general water contains various alien materials according to the quality of the water, so that it is very effective as a perfune diluent.

Next, polished crushed products are charged into a vapor-heater, and the vapor-heater is filled with perfune mixed with the distilled water, and then the vapor-heater is heated for one to two hours at a temperature ranging from 50° C. to 90° C. Then, the crushed products 20 are inflated, and minute pores of the crushed products 20 are expanded at the same time, so that perfume can permeate into the minute pores or soak into the crushed products 20.

In this instance, the distilled water performs the sterilization because the vapor-heater is employed, so that separate disinfection treatment with respect to the crushed products 20 is not required.

Herein, various perfume such as aroma, peppermint, lemon, rose, and the like can be utilized in the present invention according to the likings of the consuners.

Finally, after carrying out the step of heat treating and perfune injecting, a step (S5) of drying the crushed products of the seeds is carried out by using a drier.

As a result of above process, the crushed products of the seeds according to the present invention become the stuffing of a pillow with a small size having a diameter ranging from 2 mm to 3 mm and round shape.

Herein, after carrying out the drying step, it is possible to sort the crushed products separately according to their size, into a size of about 2 mm and a size of about 3 mm by using a separate sorter. This is because when the diameter is about 3 mm, it can be used as the stuffing of an adult pillow, and when the diameter is below 2 mm, it can be used as the stuffing of a young/infant pillow.

Meanwhile, a peach, a maesil, a prune, and the like can be used as a drupe used in the present invention.

As shown in FIG. 2, the stuffing composed of the crushed products 20, manufactured by the method as described above, can be filled entirely in a shell 11 constituting a pillow 10.

Herein, when the size of the stuffing composed of the crushed products 20 of the seeds used in the pillow 10 shown in FIG. 2 is about 2 mm, it is proper for an infant/baby or a newborn baby. In particular, it can support the newborn baby to have a good head shape because a head of a newborn baby is to be shaped at that time.

In addition, as shown in FIG. 3, a pillow can be constructed in such a fashion that a cushion material 12 composed of a sort of cotton is inserted into a shell 11 of the pillow 10, and the stuffing 20 can be filled between the cushion material 12 and the shell 11. In this instance, it is possible to improve the feelings of contact with the head of the user together with maintaining the cushion of the entire pillow, and can take a comfortable sleep or take a comfortable rest with lying due to emission of the perfune.

When the size of the stuffing 20 is about 3 mm, the pillow 10 shown in FIG. 3 is proper for an adult.

In this embodiment, the shell 11 shown in FIG. 2 and FIG. 3 is preferable to be made of natural fiber rather than chemical fiber.

INDUSTRIAL APPLICABILITY

As described above, according to the present invention, it is possible to take a comfortable sleep and have comfortable feelings at the time of taking a rest because emission of fragrance is very easy, and perfune can easily permeate into the stuffing, and it becomes very good to contact with a head of a user.

Also, according to the present invention, since the seeds of the drupes are crushed into a predetermined size and fragrance is emitted from the polished crushed products of the seeds, it becomes very helpful to take a deep sleep.

In addition, according to the present invention, perfume is permeated into the stuffing separately, it is possible to take a comfortable sleep or take a comfortable lying and rest due to perfune emitted from the stuffing.

Moreover, according to the present invention, it is possible to provide a vegetable pillow by recycling disposed drupe, so that a chemical pillow can be replaced by it.

Furthermore, according to the present invention, since fragrance is emitted from the stuffing of a pillow, although stinky such as sweat odor, underarm odor, feet odor, and the like is emitted, circunferential people including himself can feel less stinky.

Although the present invention has been described for illustrative purposes with reference to the accompanying drawings and embodiments, those skilled in the art will appreciate that various modifications, additions and substitutions are possible, without departing from the scope and spirit of the invention as disclosed in the accompanying claims.

The invention claimed is:

1. A method of manufacturing the stuffing of a pillow, comprising:

washing seeds of collected drupes to remove alien materials from the seeds;

crushing the washed seeds into a predetermined size;

polishing surfaces of the crushed seeds crushed into the predetermined size to be smooth and round; and drying the polished seeds, wherein the method further comprises:

heat treating the polished seeds with hot vapor, after the polishing step and before the drying step, wherein the heat treating step further includes injecting perfume into the polished seeds during the heat treating step, so that the perfume can be permeated into the polished seeds.

2. The method according to claim 1, wherein the polishing step is carried out by mixing and stirring the crushed seeds with polishing members.

3. A pillow manufactured by filling the stuffing manufactured by the method according to claim 2, into a shell of the pillow.

4. The pillow according to claim 3, wherein a cushion material is inserted into the shell, and the stuffing is filled between the cushion material and the shell.

5. A pillow manufactured by filling the stuffing manufactured by the method according to claim 1, into a shell of the pillow.

6. The pillow according to claim 5, wherein a cushion material is inserted into the shell, and the stuffing is filled between the cushion material and the shell.

* * * * *